United States Patent [19]

Bielagus

[11] Patent Number: 4,907,702

[45] Date of Patent: Mar. 13, 1990

[54] AUTOMATIC CHIP CLASSIFIER AND SYSTEM

[75] Inventor: Joseph B. Bielagus, Tualatin, Oreg.

[73] Assignee: Beloit Corporation, Beloit, Wis.

[21] Appl. No.: 146,990

[22] Filed: Jan. 22, 1988

[51] Int. Cl.[4] ..... B07B 13/05

[52] U.S. Cl. ..... 209/664; 209/234

[58] Field of Search ..... 209/664, 393, 394, 234, 209/237

[56] References Cited

U.S. PATENT DOCUMENTS

| | | | |
|---|---|---|---|
| 2,099,223 | 11/1937 | Paxton | 209/664 |
| 2,895,610 | 3/1959 | Copping et al. | 209/664 |
| 3,322,274 | 5/1967 | Fox | 209/664 |
| 3,831,752 | 8/1974 | Holloway | 209/394 |
| 3,938,601 | 2/1976 | Hobart | 177/DIG. 11 X |
| 4,141,451 | 2/1979 | Lapointe | 209/664 |

*Primary Examiner*—Joseph J. Rolla

*Attorney, Agent, or Firm*—Dirk J. Veneman; Raymond W. Campbell

[57] ABSTRACT

A wood chip classifier and classification system in which chips are separated into a plurality of fractions according to chip size in an apparatus having an automatically adjustable hole spacing for first removing from a sample chips in the fraction smallest in size, and subsequently removing therefrom fractions containing chips of progressively larger size. A particularly suitable apparatus includes a rotating drum for receiving chips on the inside thereof, with the perimeter of the drum being formed from a plurality of spaced rods, and the spacing between the rods being adjustable.

9 Claims, 4 Drawing Sheets

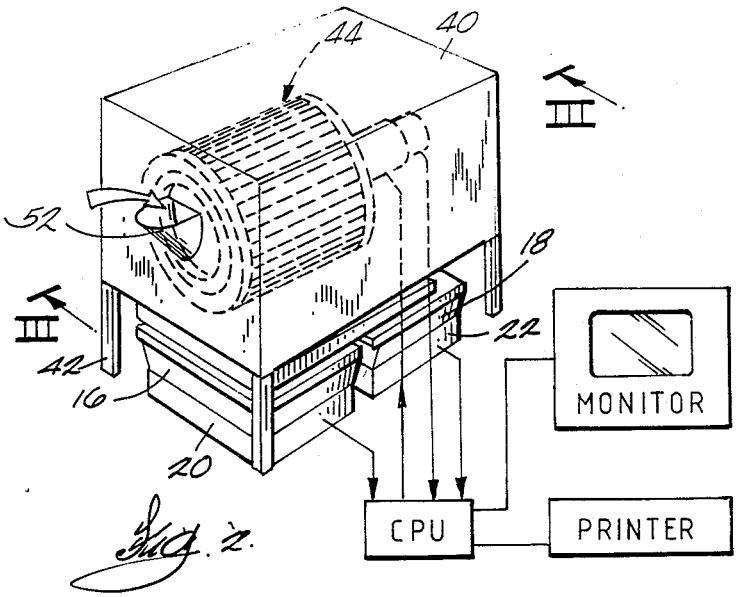
Fig. 2.
Fig. 7
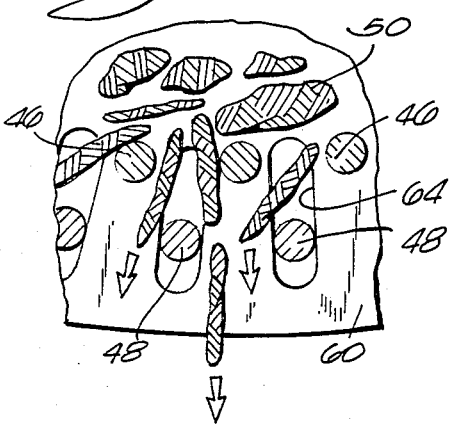
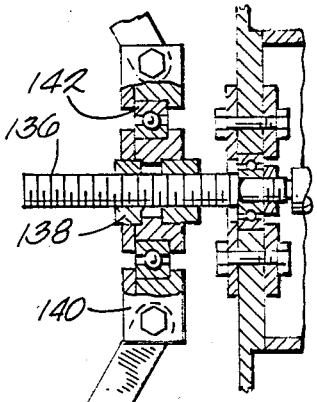
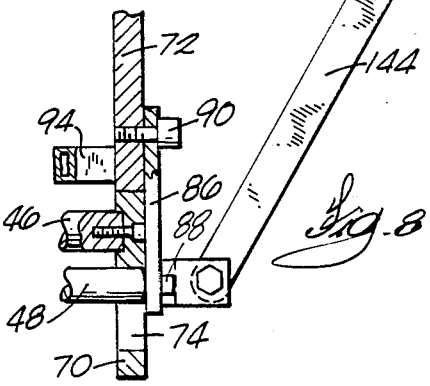
Fig. 8
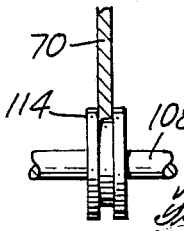
Fig. 9

AUTOMATIC CHIP CLASSIFIER AND SYSTEM

TECHNICAL FIELD

This invention relates generally to the wood chip industry, and relates more specifically to apparatus for separating by size, a random sample of wood chips, to determine the percentages of chips in various size ranges

BACKGROUND OF THE INVENTION

In many industries that utilize wood particles or wood fibers, logs are debarked and chipped before further processing. While efforts are made to create chips of consistent size; the nature of the chipping process; the characteristics of the wood being chipped, including the size of the log, and the physical characteristics of the fiber network; as well as environmental conditions, equipment condition, and the like result in the creation of a wide range of chip sizes during the chipping process. The largest percentage of chips will likely be of acceptable size; however, overly large chips and chips smaller than the desired optimum size also are created. During subsequent chip handling and storage, chips may be further destructured, creating fines and the like.

In the paper industry, wood chips are cooked in a digester with chemicals at high pressure and temperature to release the cellulosic fiber from the lining that holds the fibers together. If the wood chips are either undercooked or overcooked during the digestion process, the physical characteristics of the cellulosic fiber and any resulting paper product made therefrom can be adversely affected. Therefore, it is desirable that the chips being digested are all of substantially the same size. Undersized chips will be overcooked, and oversized chips will be undercooked when the cooking process is controlled for an intermediate size chip. Various screening techniques have been developed for separating oversized and undersized chips from the acceptable chips, so that the oversized can be reduced in size and the undersized chips can be separately handled. However, it is often desirable to generally understand what percentage of chips are oversized or undersized in any large volume before screening.

It is also common for wood users to purchase chips from wood suppliers. With the increased recognition of the importance of chip quality, purchase contracts for chips may specify acceptable percentages of chips in various size ranges for any chip shipment.

For these and other reasons, it is desirable to have available a chip classifier which can quickly and effectively process a random sample of chips and separate the chips by size, to determine the percentages of chips within a variety of size ranges.

In a typical chip classifier design, a number of vertically arranged trays are provided, each tray having holes in the bottom thereof of different size. The bottom tray may be solid and stationary. The trays are arranged such that trays with larger holes in the bottom thereof are positioned at the top of the stack, and each successively lower tray has progressively smaller holes in the bottom thereof. A sample of chips is placed in the uppermost tray, and the trays are shaken by some fashion to move and rearrange chips. Chips smaller than the holes of the tray in which they are in fall through the holes into the next lower tray until the chip is received by a tray having a hole size through which the chip will not pass. Depending on the information desired, a number of trays can be used to separate the chips. In this way, overlong chips, overthick chips, acceptable chips pin chips and fine chips can all be separated from each other.

While chip classifiers, as summarized above, have been useful, there are various limitations and drawbacks to their use. Conventional chip classifiers are very labor intensive and require extended periods of time to complete a chip size classification. The trays must be handled individually, and depending on the size of the classifier, the actual classification process can be very time consuming. The trays each must be removed and assembled as necessary, and the resultant chips volumes in each tray must be separately handled and weighed. Calculations are performed by hand. Additionally, the operator is limited to performing classifications possible with the hole sizes available for the trays being utilized. As the result of varying chip characteristics, ultimate use of the chips or the specifity of information desired, it may be necessary to obtain and store a wide variety of trays for performing different classifications.

SUMMARY OF THE INVENTION

It is therefore an object of the present invention to provide a chip classifier that can be operated quickly and efficiently with minimal operator handling.

It is another object of the present invention to provide a chip classifier which can be utilized to perform a wide variety of classifications quickly and efficiently.

Still another object of the present invention is to provide a chip classifier which can be automated in operation and which is infinitely adjustable over a specified range to provide detailed and accurate classification consistent with the information desired and the chip characteristics being presented.

These and other objects are achieved in the present invention by providing a chip classifier operating as a rotating drum, having an outer perimeter including adjustable apparatus defining holes or slots through which the chips may pass. A particularly suitable arrangement includes a set of stationary rods and a set of movable rods adjacent thereto defining a space therebetween. During operation, a volume of chips to be classified is placed in the drum, with the adjustable rods being positioned closely to the stationary rods. This permits the fraction of chips smallest in size to pass therethrough. Upon completion of removal of the small chip fraction, the adjustable rods are moved further away from the stationary rods, and a fraction of chips of larger size than the first fraction is removed from the sample. In this manner, the desired classes of chip size can be obtained from the sample.

Movement of the adjustable rods can be achieved by a link mechanism driven by a stepper motor, or the like. Scales can be positioned beneath the classifier for receiving the separated fraction, and a vibrating screen beneath the drum separates fines from the chip fraction. Adjustment of the movable rods can be performed automatically with computer monitoring of deviations in weight measurement recorded on the scales. The classifier is particularly suitable for incorporation with a computer operated control system which automatically controls and stores the weight data and the classifier rod spacing for automatically printing results upon completion of the classifying operation.

Additional objects and advantages of the present invention will be compared from the detailed description and the accompanying drawings.

BRIEF DESCRIPTION OF THE DRAWING

FIG. 2 is a perspective view and partial schematic of a chip classifier system according to the present invention.

FIG. 7 is a fragmentary perspective view, showing chips passing through the classifier.

FIG. 8 is an enlarged view showing one of the adjustment arms of the chip classifier as shown in FIG. 3.

FIG. 9 is a cross sectional view of the drive mechanism for the classifier taken along line IX—IX of FIG. 4.

DETAILED DESCRIPTION OF THE PREFERRED EMBODIMENT

Figure 1:
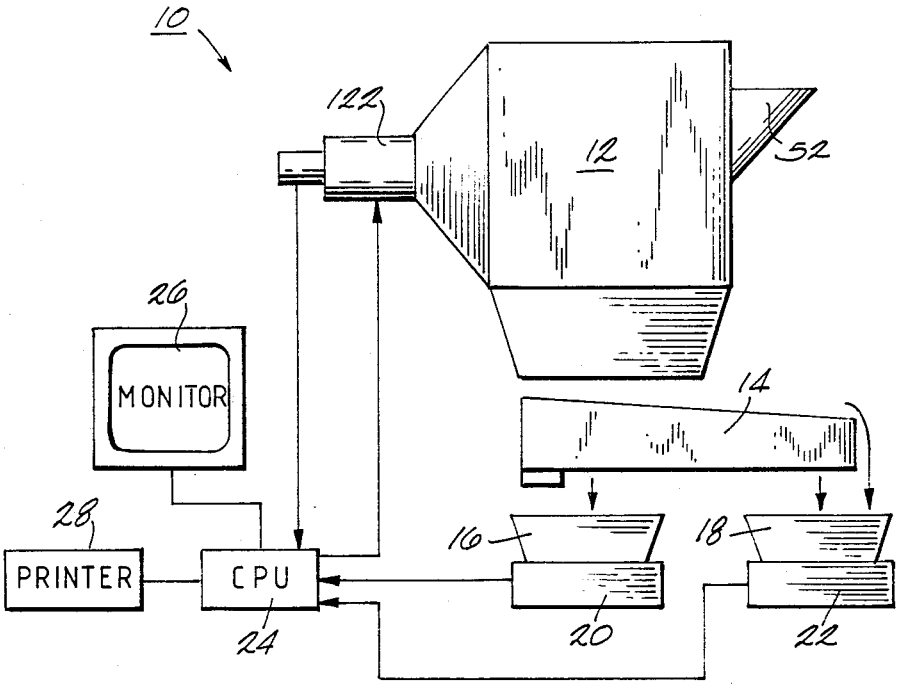
FIG. 1 is a schematic representation of a chip classifying system embodying the present invention.

Referring now more specifically to the drawings, and to FIG. 1 in particular, numeral 10 designates a chip classification system embodying the present invention, including a classifier 12, and a vibrating screen 14 for separating the chips. The vibrating screen 14 is provided to separate fines from chips received from classifier 12 and is of conventional structure and operation familiar to those versed in the art. Bins 16 and 18 are provided for receiving, respectively, the fines and chips from the vibrating screen 14. Scales 20 and 22 are provided for continuously monitoring the weights received by bins 16 and 18. As will be described more fully hereinafter, a chip classification system according to the present invention lends itself readily to automatic operation, and in this regard, various operational controls and monitors for the classifier, vibrating screen, scales, and the like will be connected to a central processing unit 24, having a monitor 26, printer 28, and other associated control apparatus.

The classifier 12, vibrating screen 14, bins 16, 18, and scales 20, 22 may be enclosed in a housing 40, having legs 42. The classifier comprises generally a rotatable drum 44, defined by a series of adjustably spaced rods between which wood chips may pass. Generally, the drum includes a series of inner rods 46 and a series of outer rods 48 adjustably spaced therefrom. As represented in FIG. 7, depending on the spacing between the inner rods 46 and the outer rods 48, chips 50 of appropriate size may pass from the inner area of the drum through the spaced rods and be deposited on vibrating screen 14. A chute 52 is provided in housing 40 for depositing a sample of wood chips in the inner area of drum 44.

Drum 44 further includes a front rod holding assembly 54 at the chute end of the drum, and a back rod holding assembly 56 at the opposite end of the drum. Front rod holding assembly 54 includes an inner ring 58 and an outer ring 60. The inner and outer rings have complimentary stepped shoulders allowing the two rings to internest while providing a flush surface. Inner ring 58 of front rod holding assembly 54 defines an opening 62 through which chute 52 extends, allowing chips to be deposited inside of the drum. Outer ring 60 defines a plurality of slots 64, each receiving one end of one of the outer rod 48.

Back rod holding assembly 56 includes an outer ring 70 and an inner body on plate 72. Similarly to the inner and outer rings of front rod holding assembly 54, the outer ring 70 and inner plate 72 of back rod holding assembly 56 define complimentary stepped shoulder regions permitting the outer ring and inner plate to internest, presenting a flat aligned surface. Outer ring 70 defines a plurality of slots 74, each receiving an end of one of the outer rods 48. The outer rods 48 are thereby adjustably secured between the front and back rod holding assemblies, being retained in slots 64 and 74 at opposite ends. Each end of each inner rod 46 is rigidly connected to the outer ring of the front and back rod holding assemblies. Such connection may be by welding, fastener, or the like. The inner rods are thereby fixedly secured between the front and back rod holding assemblies.

A plurality of rigid links 80 are provided on the front or chute end of the classifier, each rigid link being connected by a pivot pin 82, to one of the adjustable outer rods 48. The opposite end of each of the rigid links 80 is connected by a pivot pin 84 to the inner ring 58. On the backside of the classifier, a rigid link 86 is provided for the opposite end of each of the outer rods 48. Each rigid link is connected by a pivot pin 88 to an outer rod 48 and by a pivot pin 90 to the inner plate 72.

A plurality of tie or connecting rods 92 are attached to and extend between outer ring 60 and outer ring 70. A plurality of tie rods such as connecting bars 94 are attached to and extend between inner ring 58 and inner plate 72. The connecting rods and connecting bars provide longitudinal stability between the front rod holding assembly 54 and back rod holding assembly 56, ensuring proper alignment between slots 64 and 74, while transmitting relative rotational movement from the back rod holding assembly to the front rod holding assembly, as will be described more fully hereinafter.

Rotation of the drum is performed by a drive motor 96, having a drive sprocket 98 connected by a chain 100 to a sprocket 102 on a shaft 104. Front and back drive wheels 106 are disposed on shaft 104, and operate against the outer ring 60 and outer ring 70, transmitting rotational movement from the motor through the shaft to the drum. Additionally, shafts 108, 110, and 112 having idler wheels 114 operating on both the outer ring 60 and the outer ring 70 are disposed about the periphery of the drum, to ensure proper alignment thereof. FIG. 9 illustrates a typical arrangement of a drive wheel 106 or idler wheel 114 with either of the outer rings 60 or 70.

Changes in the relative position or spacing between the inner rods 46 and outer rods 48 is accomplished through a spider drive mechanism 120 operated by a stepper motor 122, or the like. An inner wall 124 is provided with a motor housing 126 attached thereto by fasteners 128, which may include bolts, pins, rivets, welding, or the like. Drive motor 96 may also be fastened to inner wall 124. Likewise, drive shaft 104 and idler shafts 108, 110, and 112 may be fastened to wall 124 by bearing mountings 130, with the opposite ends of the drive shaft and idler shafts being mounted by bearing mountings 132 to housing 40.

Motor 122 is operatively connected by a coupling 134, including a bearing 135 to a threaded rod 136. A sleeve 138, complimentarily threaded to rod 136 is threadedly engaged on the rod. Sleeve 138 is mounted in a collar 140 through a bearing 142. A plurality of actuator arms 144 are pivotly connected between the collar 140 and several of the outer rods 48. It is unnecessary to connect each of the outer rods to the collar 140; however, a sufficient number thereof should be connected to the collar, to impart smooth movement from the rotating threaded rod 136 to the outer rods 48.

Figure 3:
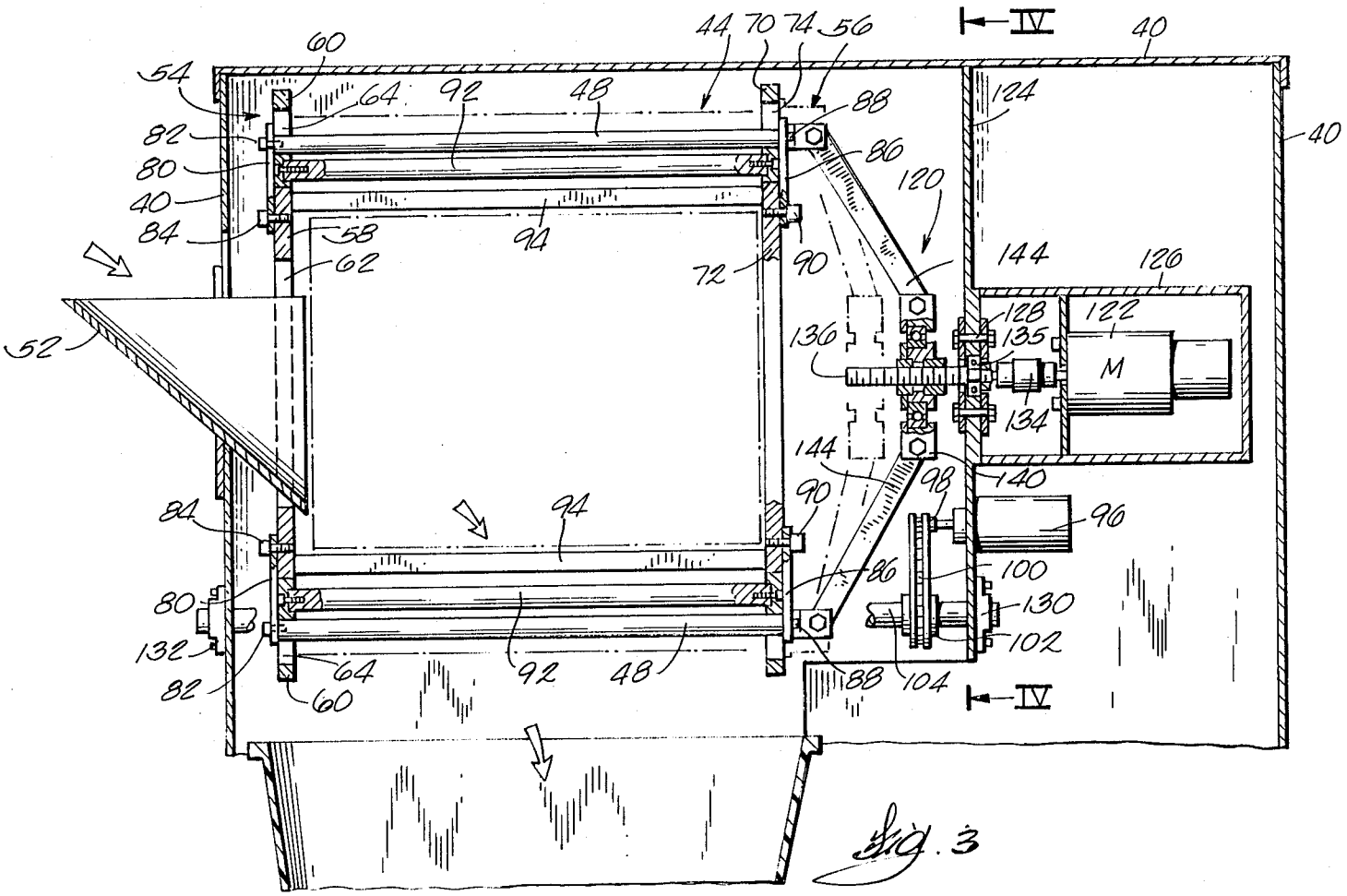
FIG. 3 is a cross sectional view of the chip classifier shown in FIG. 2, taken along line III—III of FIG. 2.
Figure 4:
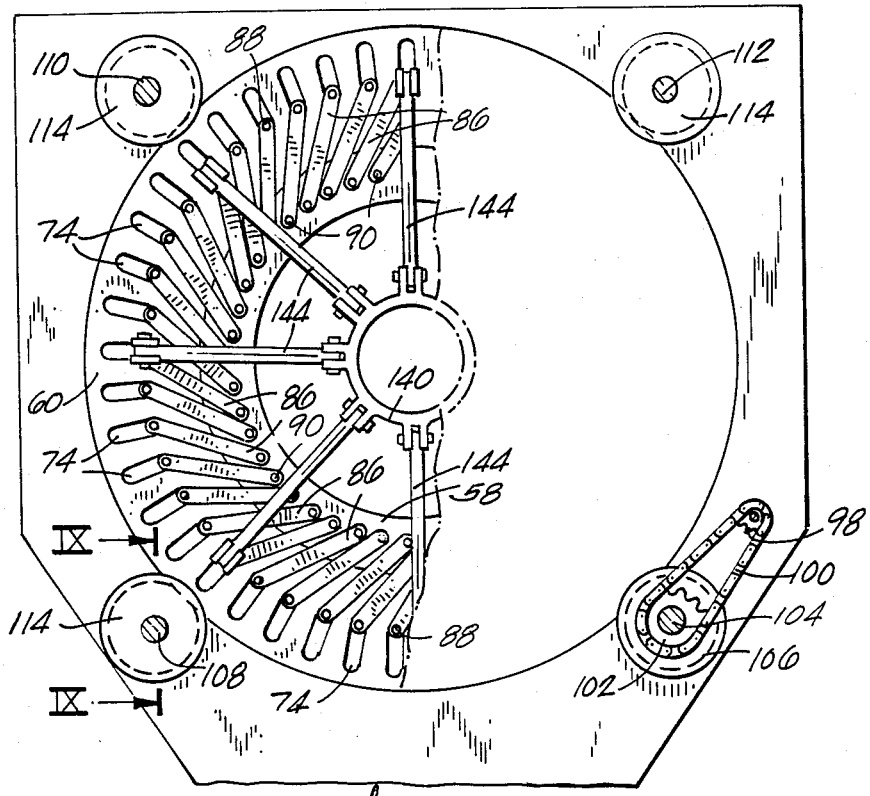
FIG. 4 is a cross sectional view, partially broken away, of the chip classifier shown in FIGS. 2 and 3, the cross section being taken generally along line IV—IV of FIG. 3.
Figure 5:
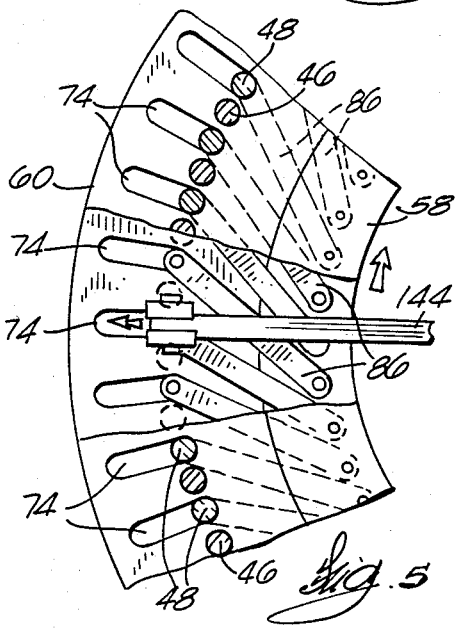
FIG. 5 is an enlarged view of the adjustment mechanism for the chip classifier shown in FIG. 4, showing the apparatus adjusted for separating from the sample the finest fraction of material contained therein.
Figure 6:
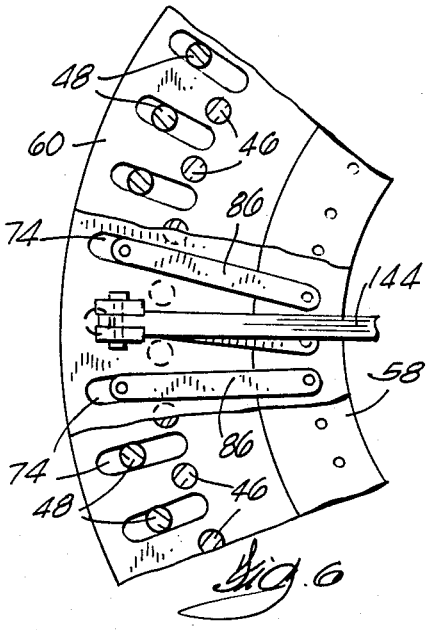
FIG. 6 is an enlarged view similar to that shown in FIG. 5, but showing the apparatus adjusted for separating chips of the largest size from the sample.

As can be most clearly seen in FIG. 3, activation of motor 122 and rotation of rod 136 causes movement of the collar 140 between an outermost position, shown in solid lines in FIG. 3, and an innermost position show in phantom lines in FIG. 3. Movement of the collar is transmitted through the actuator arms to the adjustable outer rods 48 connected to the actuator arms. The force applied against the several outer rods connected to the actuator arms is transmitted through the rigid links 80 and 86 to the inner ring 58 and inner plate 72. The resultant affect is relative rotational movement between the inner ring 58 and outer ring 60 and between the inner plate 72 and outer ring 70. This relative rotational movement is transmitted from the inner ring and plate to the remaining adjustable outer rods 48 not connected by actuator arms 144 to collar 140 through the remaining rigid links 80 and 86. Additionally, the connecting rods 92 and connecting bars 94, extending between the front and back rod holding assemblies, transmit the relative movement between the back rod holding assembly to the front rod holding assembly. The result is a smooth adjustment of the spacing between the inner and outer rods, either closer or farther apart, depending upon the direction motor 122 is operated.

In the use and operation of a chip classifier system and apparatus of the present invention, normally the classifier will be empty and the outer rods 48 positioned closely to the inner rods 46 when a sample of chips is deposited within a drum 44 through the chute 52. As the drum is rotated through the drive connection to drive motor 96, fines, pin chips, and the like will fall through the spaces between the inner and outer rods and onto the vibrating screen 14. The vibrating screen is conventional in operation, and fines will fall therethrough into bin 16. The larger chips will progress along the top of the vibrating screen, falling over the end thereof into bin 18. Scales 20 and 22 constantly monitor the weight of material being added to the bins, and when minimal increase is detected in bin 18, it indicates that most or all of the smallest chips have passed out of the drum 44. The total weight in the bins can then be recorded.

Through proper programming, once the first fraction of small chips has passed out of the drum 44, stepper motor 122 can be automatically activated to rotate threaded rod 136, thereby imparting force through spider drive mechanism 120 to the outer adjustable rods 48. Through the interconnection of the rigid links 80 and 86, connecting rods 92, and connecting bars 94 relative rotational movement is affected between inner ring 58 and outer ring 60, and between outer ring 70 and inner plate 72, thereby moving each of the outer rods 48 farther from the inner rods 46.

After adjustment of the spacing between the inner and outer rods, continued rotation of the drum 44 permits a second fraction of chips, larger in size than the chips of the first fraction, to fall out of the drum 44. Again, any fines adhering to the chips will be separated therefrom on the vibrating screen 14, with the fines being deposited in bin 16 and the chips being added to the first fraction of chips in bin 18.

In progressive fashion, a plurality of fractions can be generated, with the weight of each fraction being automatically recorded. Proper bar spacings for the desired calculations can be effected between the extreme positions permitted by the slots and spider drive mechanism. Within this range, spacing is limitless and, unlike vibrating trays used in previous classifiers, the present classifier is not limited in the chip sizes that can be separated.

As mentioned previously, programming can be utilized to automatically perform the rod adjustment when all or substantially all of a fraction has been separated from the sample. Recording of the weights of the various fractions, the chip size in the fractions, and the percentage of the total that each fraction represents can be automatically provided by the computer unit. As will be obvious to one that is skilled in the art, various additional controls and safety systems can be automatically operated from the computer, such that wedging between the rods will be detected, with an appropriate warning given so that the obstruction can be cleared.

While one embodiment of a chip classifier apparatus and system have been shown and described in detail herein, it should be recognized that various changes may be made without departing from the scope of the following claims:

I claim:

1. A chip classifier comprising;

a drum for receiving a volume of chips on the inside thereof;

said drum including a plurality of rods defining adjustable spaces at the perimeter of said drum, each of said rods having a longitudinal axis, said spaces enabling chips of predetermined thickness to pass from the inside of said drum through said spaces to the outside of said drum;

drive means for rotating said drum; and an adjustment mechanism controlling the radial position of at least some of said rods defining adjustable spaces at the perimeter of said drum for varying the thickness of chips passing from the inside of said drum to the outside of said drum by varying the size of spaces defined, said adjustment mechanism including means for moving the longitudinal axis of at least some of said rods along a substantially radial path.

2. A chip classifier as defined in claim 1, in which said plurality of rods includes a first set of rods each fixed in location, and a second set of rods of said plurality of rods each movable along defined radial paths, said rods of said second set of rods being adjustably spaced from said rods of said first set of rods.

3. A chip classifier as defined in claim 2, in which said rods of said second set of rods are connected to drive means for controlling the position thereof.

4. A chip classifier as defined in claim 3, in which said drum includes a first end and a second end, an outer ring and an inner body rotatable relative to each other are disposed at each said first end and said second end of said drum, the rods of said second set of rods are disposed in slots in each said outer ring, and a rigid link is provided for each end of each of said rods of said second set of rods, said rigid links being pivotally connected at one end to a rod of said second set of rods, and at the other end to a said inner body.

5. A chip classifier as defined in claim 4, in which tie rods are disposed between said inner body of said first end and said inner body of said second end, and between said outer ring of said first end and said outer 6. A chip classifier as defined in claim 4, in which said adjustment mechanism includes means connected to at least some rods of said second set of rods for applying force to said at least some rods of said second set of rods for moving the said at least some rods in their respective slots.

7. A chip classifier as defined in claim 1, in which a vibrating screen is disposed beneath said drum and receives chips passing through said spaces for separating fines from said chips passing through said drum and received by said screen.

8. A chip classifier as defined in claim 7, in which separate receiving means are provided for collecting fines from said vibrating screen and chips passing over said screen.

9. A chip classifier as defined in claim 8, in which scales are provided for constantly monitoring the weight of material received by said receiving means.

* * * * *

UNITED STATES PATENT AND TRADEMARK OFFICE

CERTIFICATE OF CORRECTION

PATENT NO. : 4,907,702

DATED : March 13, 1990

INVENTOR(S) : Joseph Bielagus

It is certified that error appears in the above—identified patent and that said Letters Patent is hereby corrected as shown below:

Column 7, line 6, complete claim 5 with the phrase --ring of said second end.--

Signed and Sealed this

Eleventh Day of June, 1991

*Attest:*

*Attesting Officer*

HARRY F. MANBECK, JR.

*Commissioner of Patents and Trademarks*